US007044582B2

(12) United States Patent
Fredrickson et al.

(10) Patent No.: US 7,044,582 B2
(45) **Date of Patent: *May 16, 2006**

(54) AERODYNAMIC FAIRING STRUCTURE FOR INKJET PRINTING

(75) Inventors: Daniel J. Fredrickson, Camas, WA (US); Antonio Gomez, Vancouver, WA (US)

(73) Assignee: Hewlett-Parkard Development Company, L.P., Houston, TX (US)

( * ) Notice: Subject to any disclaimer, the term of this patent is extended or adjusted under 35 U.S.C. 154(b) by 229 days.

This patent is subject to a terminal disclaimer.

(21) Appl. No.: 10/401,924

(22) Filed: Mar. 28, 2003

(65) Prior Publication Data

US 2003/0206209 A1 Nov. 6, 2003

Related U.S. Application Data

(63) Continuation of application No. 10/066,114, filed on Jan. 31, 2002, now Pat. No. 6,565,182.

(51) Int. Cl.
*B41J 23/00* (2006.01)
*B41J 2/165* (2006.01)

(52) U.S. Cl. ..... 347/37; 347/34

(58) Field of Classification Search ..... 347/20, 347/22, 34, 37, 104, 101; B41J 2/15, 2/165, B41J 23/00, 2/01

See application file for complete search history.

(56) References Cited

U.S. PATENT DOCUMENTS

| | | | | |
|---|---|---|---|---|
| 4,297,712 | A * | 10/1981 | Lammers et al. | 347/21 |
| 4,591,869 | A * | 5/1986 | Katerberg et al. | 347/21 |
| 4,623,897 | A * | 11/1986 | Brown et al. | 347/74 |
| 4,638,327 | A * | 1/1987 | Sutera et al. | 347/94 |
| 5,774,141 | A * | 6/1998 | Cooper et al. | 347/34 |
| 6,561,620 | B1 * | 5/2003 | Pietrzyk et al. | 347/34 |
| 2003/0210294 | A1 * | 11/2003 | Frederickson et al. | 347/22 |

* cited by examiner

*Primary Examiner*—Stephen Meier
*Assistant Examiner*—Leonard Liang

(57) ABSTRACT

A printing device is provided which includes ink-dispensing structure which carries a printhead with a leading edge, and which moves in a printing sweep downstream across a printzone, a fairing structure, and a mounting structure which supports the fairing structure for movement with the printhead downstream from the leading edge of the printhead in a position configured to reduce aerodynamic turbulence associated with the leading edge of the printhead during movement of the printhead downstream across the printzone.

17 Claims, 6 Drawing Sheets

Exhibit A

AERODYNAMIC FAIRING STRUCTURE FOR INKJET PRINTING

CROSS REFERENCE TO RELATED APPLICATIONS

This is a continuation of application Ser. No. 10/066,114 filed on Jan. 31, 2002, now U.S. Pat. No. 6,565,182 which is hereby incorporated by reference herein.

BACKGROUND

Swath-height error involves the variation in the swath of ink that printheads in a printing device, such as in an inkjet printer, print on media. Variation in the swath height may directly impact print quality, and may be responsible for so-called swath boundary banding. Single-pass printing is especially sensitive to boundary banding, because errors may be difficult to cover up with masking techniques. As printer carriage speeds have increased over time, dynamic swath-height error due to aerodynamic effects has become more and more prevalent, especially during single-pass, bidirectional printing. Single-pass printing, and rapid carriage speeds, are typical today to meet expected printer throughput goals. In the ink-dispensing printhead structure carried by a typical printer carriage, the end printheads in the usual group of printheads are the most affected by this phenomena of swath-height error.

SUMMARY

A printing device is provided which includes ink-dispensing structure which carries a printhead with a leading edge, and which moves in a printing sweep downstream across a printzone, a fairing structure, and a mounting which supports mounting the fairing structure for movement with the printhead downstream from the leading edge of the printhead in a position configured to reduce aerodynamic turbulence associated with the leading edge of the printhead during movement of the printhead downstream across the printzone.

DETAILED DESCRIPTION

As we have discovered, if printheads, and particularly leading edges of end printheads, are barriered aerodynamically by a skirt or a fairing, aerodynamic swath-height error can be reduced. For such a fairing to be effective, it typically will be proximate the printheads nozzle location, and proximate the surface of media being printed on in the printzone. As a consequence, aerosol ink may build up on such a fairing, and may attract fibers, both of which conditions can collectively result in fiber tracts. Effective use of a fairing therefore suggests cleaning the fairing structure periodically to deal with the build-up of ink and fibers.

A fairing structure which is deployable and undeployable (retractable in the service station between deployed and nondeployed positions) may help to deal with space considerations as described above. To aid in handling the deployment/retraction matters, an actuator may be provided adjacent (or in) the service station for shifting the fairing structure between a deployed position (to which it may be biased normally by a yieldable biasing spring), and a nondeployed position. This actuator may also be associated with a wiping/blotting/doctoring structure in the form of a pad or wiper that may act to remove, or otherwise deal -with, buildup of aerosol ink and/or media fibers. Actuator structure may be provided adjacent opposite ends of the printzone to permit doctoring of the fairing structure selectively at different times when the carriage and printhead structure are either within and outside of the service station.

Figure 1:
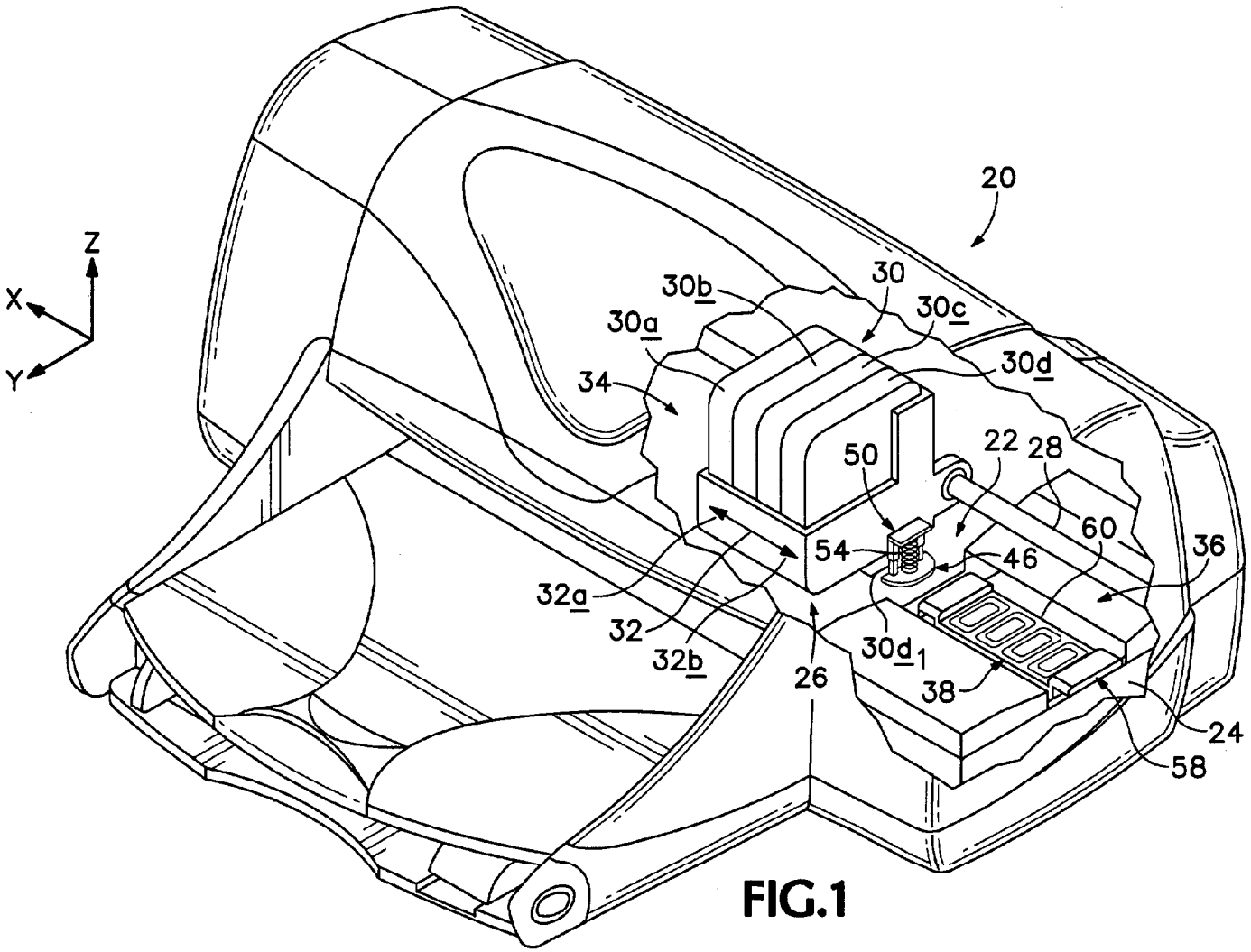
FIG. 1 is a top perspective view, with a portion broken away, illustrating a printing device which employs, and operates in accordance with, an embodiment of the present invention.
Figure 2:
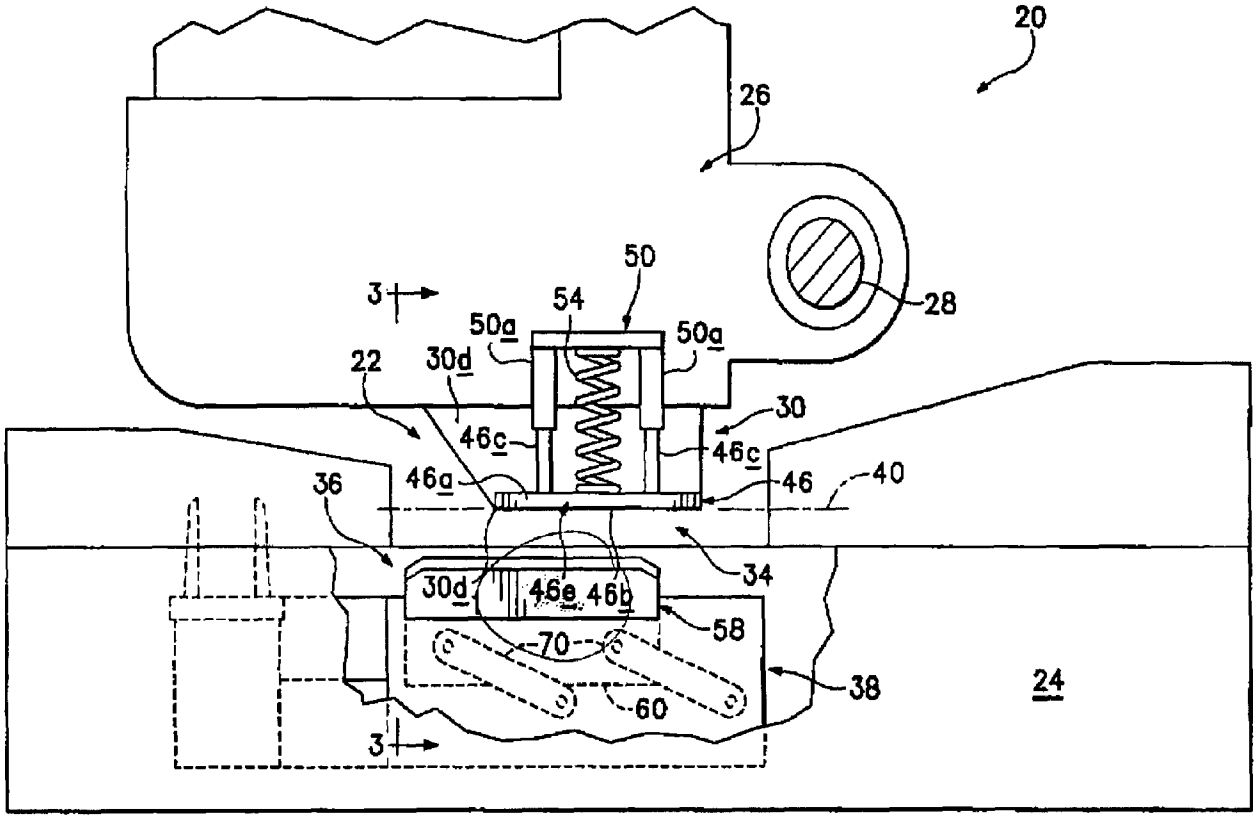
FIG. 2 is a somewhat larger-scale, fragmentary side elevation view, further illustrating an apparatus for reducing swath-height error as employed in the printing device of FIG. 1.

Turning attention now to the drawings, and referring first to FIG. 1, indicated generally at 20 is an inkjet printer which includes one embodiment of swath-height error-reducing apparatus constructed in accordance with an embodiment of the present invention, and generally illustrated at 22. It will be appreciated that although an inkjet printer is shown for illustrative purposes, the present invention may be employed in various printing devices, including copiers, facsimile machines, etc.

Included in printer 20, and mounted on the printer's frame, which is shown fragmentarily at 24, is a bidirectionally reciprocating carriage 26 which rides back and forth on a supporting carriage rail 28. Carriage 26 carries ink-dispensing printhead structure 30, which here includes a group of four printheads 30*a*, 30*b*, 30*c*, 30*d*, in which group, printheads 30*a* and 30*d* are referred to as end printheads. Each printhead includes an array of plural ink-dispensing nozzles, such as the several nozzles whose ink exit faces are shown generally at 31 for printhead 30*d* in FIG. 4.

Under the influence of appropriate reciprocal drive mechanism, carriage 26, during a printing operation, may move the printhead structure back and forth in successive reverse-direction printing sweeps single—pass printing sweeps—generally in the direction of double-ended arrow 32 over a printzone 34 (FIG. 3) wherein print media is transported closely adjacent the underside printhead-tip or nozzle surfaces (typically co-planar surfaces) in the adjacent printheads.

Located appropriately adjacent one end of the printzone, near one end of carriage travel along rail 28, is a home or service station shown generally at 36, wherein carriage 26 and printhead structure 30 may park and remain between printing operations. In this service station, servicing activities for the printhead structure take place, such as protective capping of the printhead nozzles by a capping structure shown generally at 38 in FIG. 1. As will be described shortly, attached or joined to a moveable sled component in capping structure 38 are a pair of spaced actuators, or engagement structures, which may be employed to shift a pair of fairing structures between deployed and nondeployed (or retracted) positions relative to the printhead structure, and to the printheads in the printhead structure. Shown at the left side of FIG. 1 are X, Y and Z orthogonal axes usually referred to with respect to the positionings and motions of things in the structure and operation of printer 20.

Figure 3:
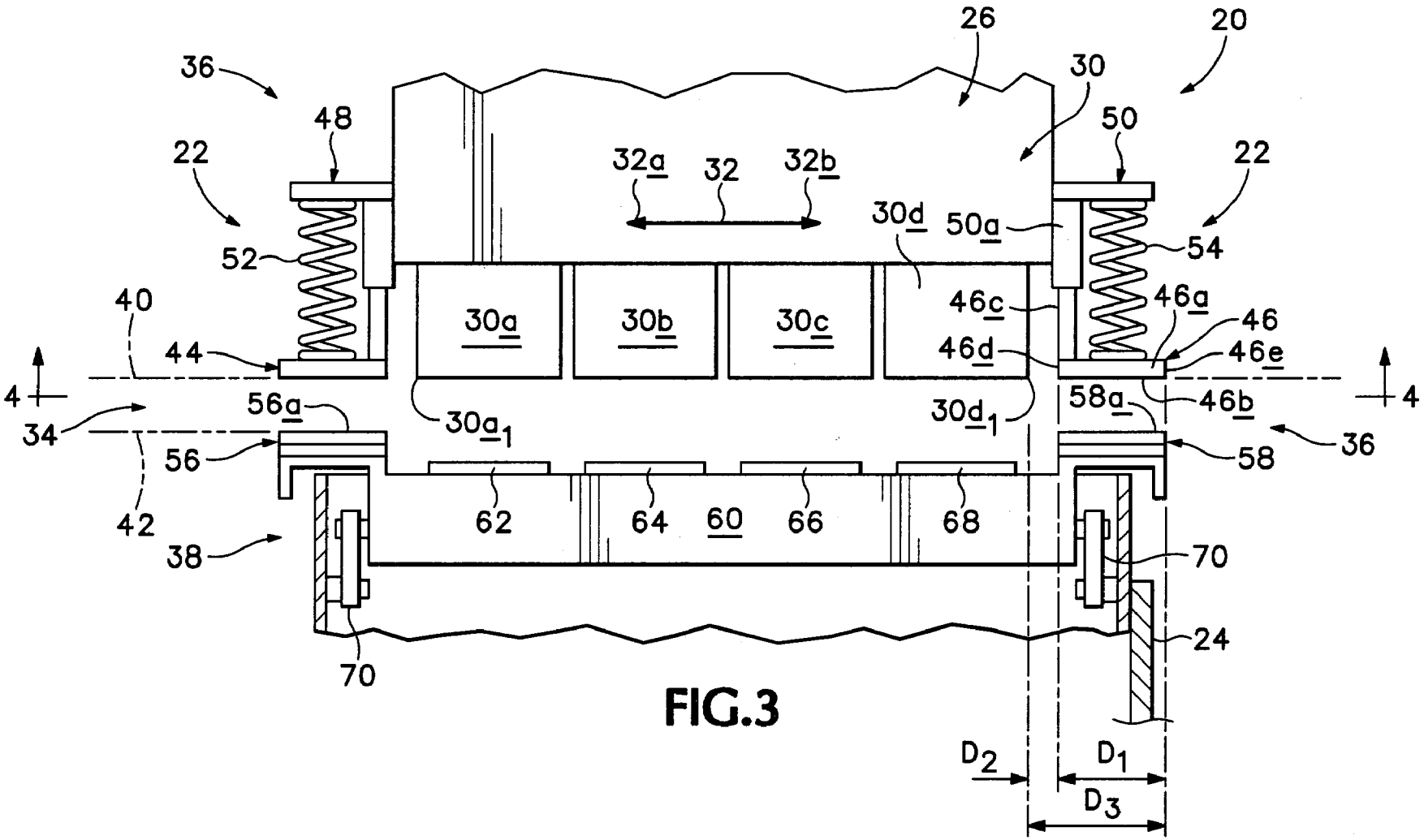
FIG. 3 is a front elevation view taken generally along the line 3—3 in FIG. 2, showing fairing structure in a deployed position relative to associated ink-dispensing printhead structure and printhead carriage.

Turning attention now to FIGS. 2–6 along with FIG. 1, opposite end printheads 30*a*, 30*d* in the printhead structure define what are referred to herein as leading edges $\mathbf{30}a_1$ and $\mathbf{30}d_1$, respectively. These leading edges are the edges of the end printheads which lead the respective forward advances of these printheads across the printzone during the different reversible directions of travel of a printing operation, indicated by arrow 32. This printzone, which is shown generally at 34 in FIG. 1, is pictured in FIG. 3 as a zone generally lying between a dash-dot line 40 and a dash-double-dot line 42. Printzone 34 is pictured toward the left side in FIG. 3 because FIG. 3 illustrates the carriage and the printhead structure generally stationed within service station 36. Accordingly, reversible travel of the carriage along rail 28 to transport the printhead structure back and forth over and across printzone 34 takes place to the left of station 36 in FIG. 3, and also to the left, generally of station 36 as such is pictured in FIG. 1.

Referring now particularly to FIG. 3, Printhead edge $\mathbf{30}a_1$ is the leading, advancing edge of printhead 30*a* with travel of this printhead generally in the direction of arrowhead 32*a* of arrow 32, downstream across printzone 34. Edge $\mathbf{30}d_1$ of printhead 30*d* plays the same role with respect to printhead 30*d* during advancing motion of that printhead downstream across printzone 34, generally in the direction of arrowhead 32*b* of arrow 32. It is the respective leading motions of printheads 30*a*, 30*d*, and their respective leading edges $\mathbf{30}a_1$ and $\mathbf{30}d_1$ which may create the kind of aerodynamic turbulence that generates swath-height error of the type which is now addressed.

One thing which should be noted with respect to printheads 30*a*–30*d*, and as can be seen particularly well in FIG. 3, is that the underside nozzle surfaces (and thus the previously-mentioned nozzle exit faces) in these printheads typically lie substantially in a common plane, which is also illustrated by previously-mentioned dash-dot line 40.

Apparatus 22, in the embodiment of the invention now being described, includes a pair of downwardly spring-biased fairing structures 44, 46 which are carried for vertical, reversible reciprocation adjacent the opposite ends of carriage 26 and printhead structure 30. These fairing structures 44, 46 may be carried by mounting structures 48, 50, respectively. Yieldable biasing springs 52, 54, in turn may be operatively interposed, and acting between, the respecting associated fairing and mounting structures to produce actions which will shortly be described.

Fairing structure 44, its associated mounting structure 48, and biasing spring 52 are shown adjacent printhead 30*a*, with mounting structure 48 being suitably anchored to the corresponding adjacent side of carriage 26. Fairing structure 46, its associated mounting structure 50, and biasing spring 54 are shown adjacent printhead 30*d*, with mounting structure 50 being suitably anchored to the corresponding adjacent side of carriage 26. These fairing, mounting and biasing structures are substantially mirror-images of one another, and accordingly, only the structural assembly of structures 46 and biasing spring 54 will now be described in further detail.

Figure 4:
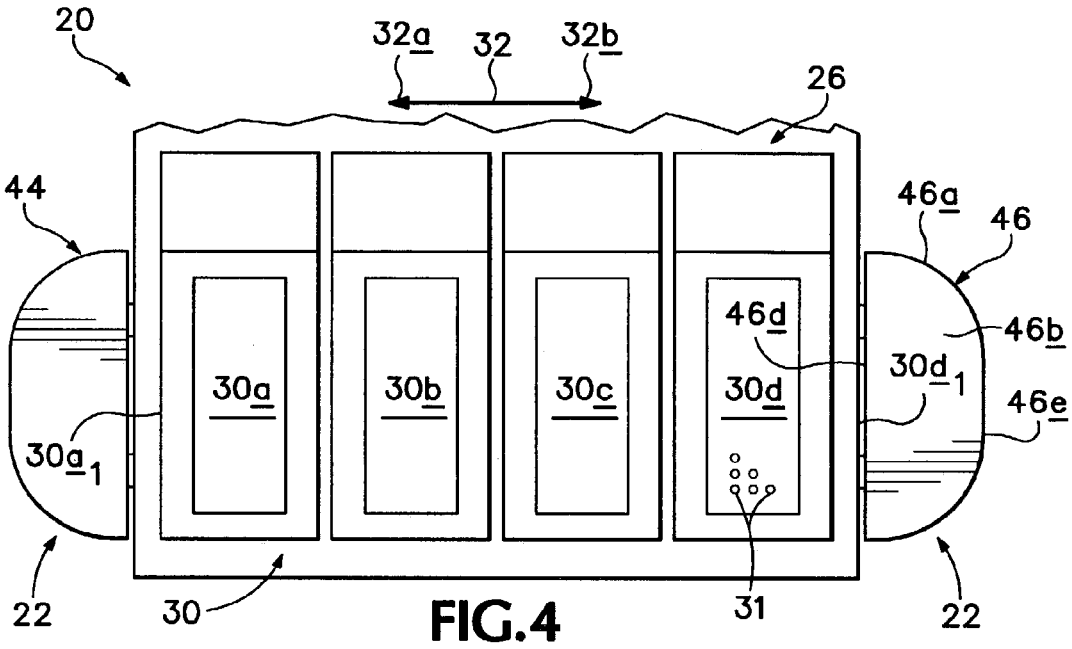
FIG. 4 is a bottom plan view taken generally along the line 4—4 in FIG. 3.

Fairing structure 46 typically includes a downwardly-facing plate 46*a* which has a perimeter outline that is most clearly shown in FIG. 4. The underside of plate 46*a* has a planar face 46*b* which typically lies in the same plane (dash-dot line 40) occupied by the bottom faces of printheads 30*a*–30*d* and the nozzle exit 30, faces earlier mentioned. In the particular assembly now being described, plate 46*a* has a dimension measured generally in the direction of carriage travel (the X direction), shown at $D_1$ in FIG. 3, of approximately 6- to 10-millimeters, a dimension extending normal to the plane of FIG. 3 (the Y direction) which is typically substantially the same as the dimension measured in the same direction of printhead edge $\mathbf{30}d_1$ (which is approximately 32-millimeters in a typical range of approximately 30- to approximately 35-millimeters), and a thickness measured in a vertical direction (the Z direction) in FIG. 3 of approximately 2-millimeters. The distance between an edge 46*d* of plate 46*a* (which edge is referred to herein as a trailing edge in this plate) and edge $\mathbf{30}d_1$, such distance being shown at $D_2$ in FIG. 3 herein, typically is approximately 2-millimeters. The result of this arrangement is that the distance between edge $\mathbf{30}d_1$, and the right-most extremity or leading edge 46*e* in plate 46*a*, as shown in FIGS. 3 and 4 (in the X direction), is approximately 8- to 12-millimeters. This dimension is shown at $D_3$ in FIG. 3.

In fairing structure 46, plate 46*a* is joined to a pair of laterally-spaced, upwardly-extending legs 46*c*, which may be slidably received in downwardly-extending tubes 50*a* of mounting structure 50. An appropriate travel-limit interference structure (not shown) associated with the interface between legs 46*c* and tubes 50*a* may limit downward travel of fairing structure 46 relative to mounting structure 50 to that which is pictured for this fairing structure in FIG. 3. This position for the fairing structure is referred to herein as the deployed position for that fairing structure. Slightly compressed biasing spring 54 may yieldably urge the fairing structure to this deployed condition by acting, as generally indicated, between fairing structure 46 and its associated mounting structure 50.

With the fairing structures in their deployed positions relative to the printhead structure during a printing operation, these fairing structures (and particularly the plates thereof, like plate 46*a*) may act as leading-edge surrogates for printhead edges $\mathbf{30}a_1$, $\mathbf{30}d_1$, depending upon the direction of travel of the carriage and printhead structure through and across the printzone. As such, these fairing structures may change the aerodynamic experience of the leading edges of the end printheads, and may do so in a fashion which reduces turbulence normally experienced by these printhead edges such that swath-height error discussed earlier may be significantly reduced.

While certain dimensions have been given as useful illustrations for the fairing structures described so far, there is a range of sizes and dimensions in each of the categories mentioned earlier which have been found to produce operating structures that are very satisfactory for different operating conditions. For example, while the Y dimension of the fairing structures' plates (such as plate 46*a*) typically may be at least the same as the Y dimensions of the printheads' leading edges, the X dimension of these fairing plate structures might typically lie in the range of between just a few millimeters and approximately 15-millimeters. The Z-axis dimension of the plates in the fairing structures might typically lie in the range of approximately 1- to 4-millimeters. The distance, shown at $D_2$ in FIG. 3, between the leading edge of an end printhead and the adjacent fairing structure plate, might typically lie in the range of approximately 1- to 15-millimeters. None of these dimensions are independently critical.

Figure 5:
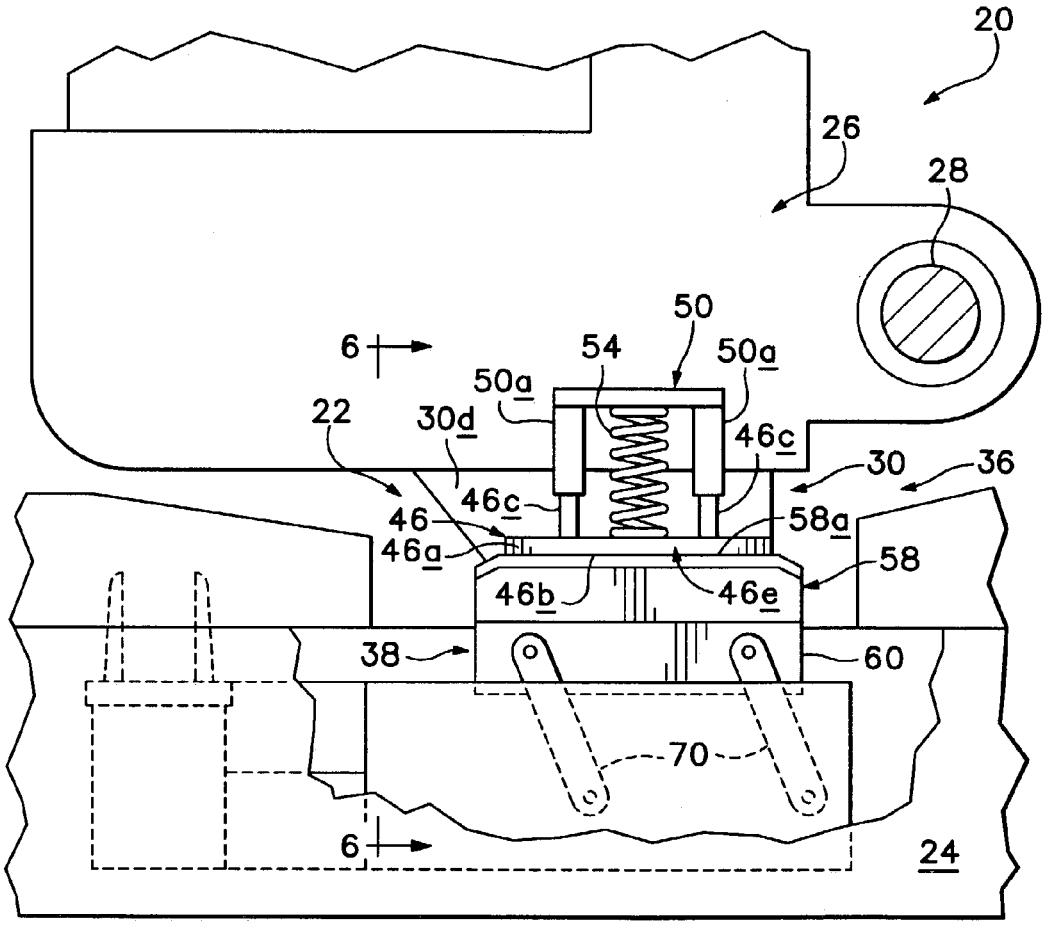
FIG. 5 illustrates the fairing structure of FIG. 4 under circumstances where the printhead carriage has entered a service station, and capping structure has been raised both to cap the printhead structure and to lift actuator structure associated with the capping structure, and to engage and shift fairing structure toward and into a nondeployed or retracted position from a spring-biased deployed position.
Figure 6:
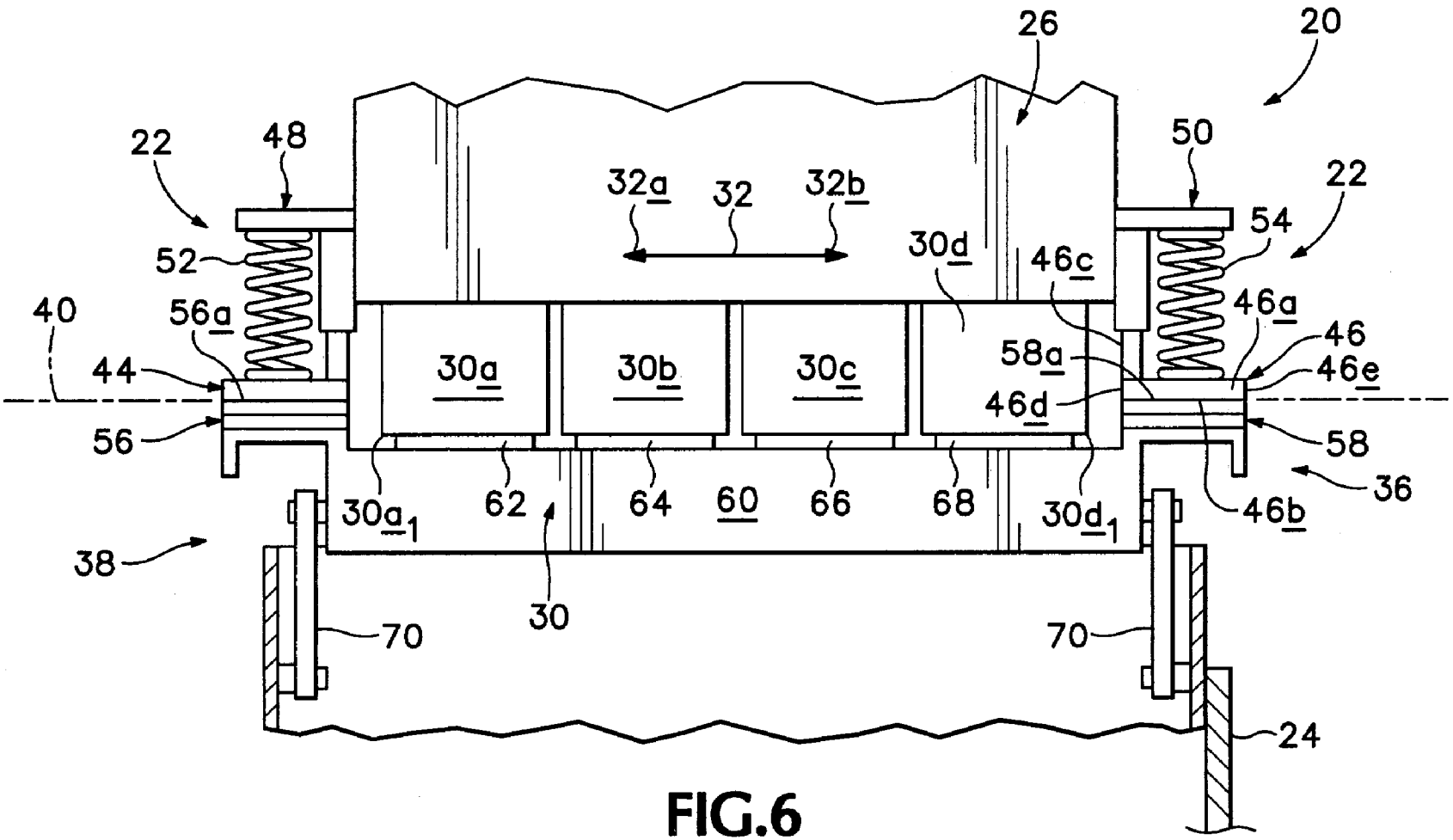
FIG. 6 is a front elevation view taken generally along the line 6—6 in FIG. 5.

Referring now to FIGS. 3, 5 and 6, it will be noted that suitably formed on, and/or mounted adjacent, opposite ends (in the X-axis direction) of capping structure 38 are a pair of actuators shown at 56, 58 which may effectively directly underlie fairing structures 44, 46, respectively, when the printhead structure is in the servicing position. Except with respect to the presence of actuators 56, 58, capping structure 38 may be in other ways conventional in construction. As indicated, capping structure 38 may include a vertically-shiftable sled 60 which may carry four individual capping elements 62, 64, 66, 68 configured to cap off the nozzles in printheads 30*a*, 30*b*, 30*c*, 30*d*, respectively. Sled 60 may be supported for raising and lowering relative to frame 24 by conventional motor-driven pantograph mechanism, including sets of pivoted pantograph arms, such as those shown at 70.

Included in actuators 56, 58, are fairing plate engagement pads 56*a*, 58*a*, respectively, which may be blotter-like pads. These pads may be configured to engage the undersides of the fairing plates (such as underside 46*b* of fairing plate 46*a*), and to doctor and clean them of accumulated aerosol ink and fibers (or to compress such deposits so that they are effectively not the creators of problems, such as fiber tract problems, during a printing operation).

When the carriage and the printhead structures have moved into service station 36, initially the capping structure may be spaced beneath the carriage and the printhead structure, as illustrated in FIG. 3. Thereafter, the pantograph mechanism which raises sled 60 in the capping structure may be operated, with the result that the capping structure moves upwardly to close off and protect the nozzles in the overlying printheads. At the same time, the capping structure may drive actuators 56, 58 upwardly to engage the undersides of the plates of fairing structures 44, 46. When this fairing plate engagement occurs, the fairing structures may be shifted upwardly in the positive Z direction in the printer against the yieldable resistance of biasing springs 52, 54, thereby shifting the fairing structures toward their undeployed and retracted positions. Pads 56*a*, 58*a* thus provide servicing (as indicated earlier) to the undersurfaces of the fairing plates and capping elements 62–68, engage and cap off the nozzles of printheads 30*a*–30*d*, respectively. This combined condition of capped-off nozzles, and lifted and undeployed fairing structures is pictured in FIGS. 5 and 6.

When a new printing operation is called for, the capping structure may return to the condition shown in FIG. 3, the fairing structures, under the influences of biasing springs 52, 54, may return to their respective deployed positions from their nondeployed positions, and a printing operation can take place with the fairing structures performing in accordance with the aerodynamic barriering operation of the present invention.

Figure 7:
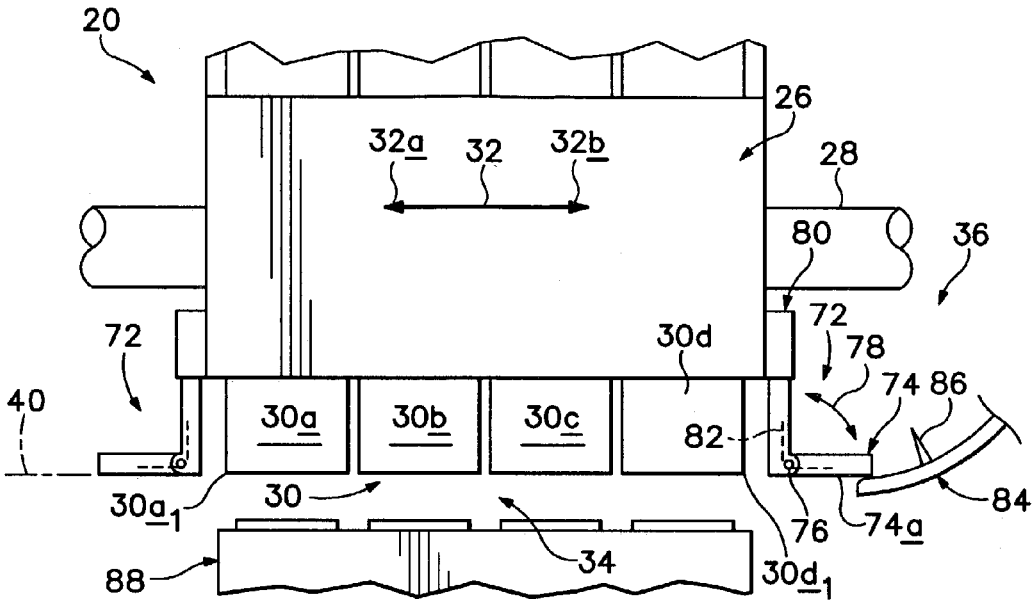
FIG. 7 is a view somewhat like that presented in FIG. 3, but here showing another embodiment of the invention, which includes a hinge-type, swingably movable fairing structure.
Figure 8:
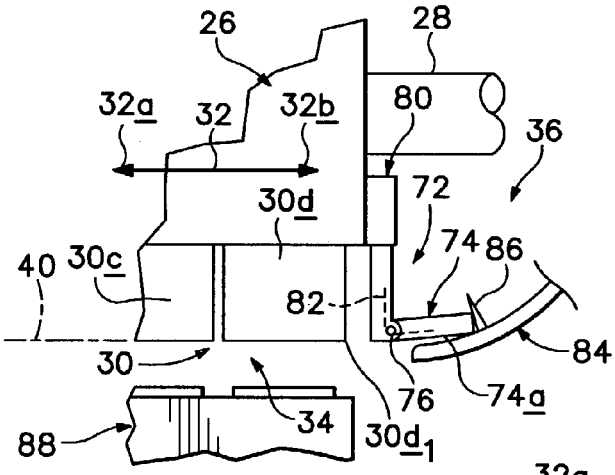
FIGS. 8 and 9 are fragmentary front elevation views depicting retraction of the hinged fairing structure in FIG. 7, and engagement of the fairing structure to clean it of ink build-up and fibers.
Figure 9:
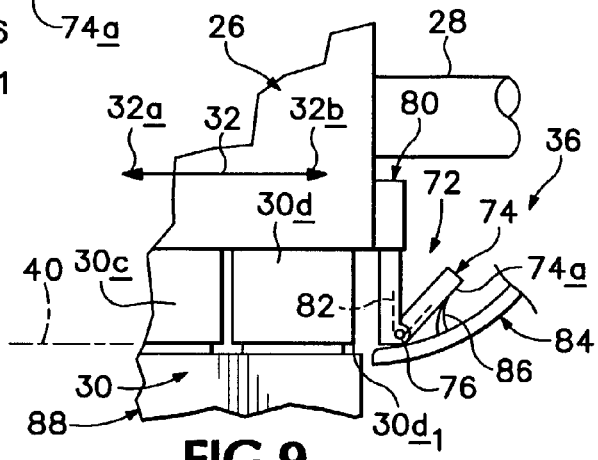

FIGS. 7, 8 and 9 illustrate apparatus, shown generally at 72 in FIG. 7. With respect to the description of apparatus 72, this description will be given for one only of the structural assemblies shown, just as was done with respect to one only of the two fairing, mounting and spring-biasing structures of apparatus 22. As was true with respect to the "opposite-end" components in apparatus 22, those in apparatus 72 can be thought of as being substantial mirror-image duplicates.

Thus, on the right side of carriage 26 in FIGS. 7, 8 and 9, the portion of apparatus 72 which is specifically pictured includes a generally planar fairing plate 74 which may be hinged at 76 for swinging reversibly, as indicated by double-ended curved arrow 78, about an axis which is generally normal to the plane of FIGS. 7, 8 and 9 (the Y direction). Plate 74 thus may be pivoted to the lower end of a mounting structure 80 that may be suitably formed on, or anchored to, the right side of carriage 26 in FIGS. 7, 8 and 9, next to end printhead 30*d*. As pictured in FIG. 7, the lower surface 74*a* in fairing plate 74 typically lies in the same plane previously discussed with respect to the lower faces of printheads 30*a*–30*d*, which plane, as in FIG. 3, is represented by dash-dot line 40. This is the deployed position for plate 74. The fairing plates, such as plate 74, may be urged into these deployed positions, relative to their respective mounting structures, by yieldable torsion biasing springs, such as spring 82 which may act between fairing plate 74 and mounting structure 80.

With the fairing plates in apparatus 72 deployed as indicated in FIG. 7, these plates may perform aerodynamically during a printing operation in a similar manner to that described earlier for the fairing plates in apparatus 22. In apparatus 72, as pictured in FIGS. 7, 8 and 9, the dimensions and overall configurations of the fairing plates, and the spatial relationships of these plates to end printheads 30*a*–30*d*, may be substantially the same as those described earlier with reference to apparatus 22.

Apparatus 72 may employ camming, ramp-like curved actuators, such as actuator 84 which is shown fragmentarily at the right sides of FIGS. 7, 8 and 9 in association with fairing plate 74 for urging the fairing plates (by swinging them) away from their deployed positions and toward nondeployed (retracted) positions. In FIG. 7, carriage 26 and printhead structure 30 are shown in conditions just entering service station 36. Specifically, they are shown in conditions where the right-hand side of fairing plate 74 has just begun to engage the upper, concavely-curved surface of ramp 84. It will be appreciated, however, that the camming actuator may take various other forms. As shown, ramp 84 may be mounted to the frame of the printing device within service station 36. A corresponding ramp (not shown) may be mounted adjacent an opposite end of carriage travel.

Joined to the upper surface of ramp 84, at the location generally indicated, there may be an upwardly-extending and slightly inclined, thin and very flexible wiper blade 86. Wiper blade 86 may function herein, along with the ramp, as a servicing and doctoring structure to deal with the build-up of ink and fiber accumulation on fairing plate 74, and on its undersurface 74*a*. Wiper blade 86 may be formed of any suitable material, such as synthetic rubber material, which typically is compatible with wiping ink.

As the carriage and printhead structure continue to advance into the service station, ramp 84 may cause plate 74 to swing upwardly about axis 76 toward a nondeployed, retracted angular position relative to mounting structure 80. As this occurs, the upper surface portion of ramp 84 (which engages plate 74), along with flexible blade 86, may perform a wiping, doctoring and cleaning action with respect to fairing plate 74. When the carriage and printhead structure are fully stationed in service station 36, as illustrated fragmentarily in FIG. 9, fairing plate 74 may be fully angularly retracted. Furthermore, there may be sufficient room and clearance beneath and beside the printhead structure to allow normal raising (and later lowering) operation of a conventional capping structure shown at 88.

A printing device equipped with the apparatus form of the invention pictured in FIGS. 7, 8 and 9 may also preferably be provided with a suitable internal system which allows a user, typically through operation of a connected computer, or through a selection device provided and accessible on the printer per se, to select, periodically, to perform a servicing operation on either fairing structure. Such may be done by placing the printing device in a mode of operation which causes the carriage and printhead structure to shift appropriately toward this or the other end of the printzone a sufficient distance to cause the corresponding ramp and wiper to furnish cleaning and/or servicing of the corresponding fairing plate. Alternatively, or in addition, the so-called cleaning operation may occur automatically, under normal operating conditions of the printing device.

The leading edges of printheads that move back and forth across a printzone in an inkjet printer are prone to generate a printing quality issue called swath-height error. This error occurs as a consequence of aerodynamic turbulence associated with leading-edge motion of a printhead as it advances at high speed, and close to print media, across such a zone. Illustrated herein are structure and methodology which reduces swath-height error by introducing and employing aerodynamic barriering and guarding of these edges through fairing structure which is selectively disposed operatively downstream (in advance) of printhead leading-edge structure.

While the invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

What is claimed is:

1. A printing device, comprising:

an ink-dispensing structure which carries a printhead with a leading edge, and which moves in a printing sweep downstream across a printzone;

a fairing structure downstream from the leading edge of the printhead; and a mounting structure which supports the fairing structure for movement with the printhead downstream from the leading edge of the printhead in a position configured to reduce aerodynamic turbulence associated with the leading edge of the printhead during movement of the printhead downstream across the printzone.

2. A printing device according to claim 1, wherein the fairing structure is yieldably spring-biased toward a deployed position.

3. A printing device according to claim 1, which further comprises a moveable capping structure movable into and out of a capping condition, and wherein the capping structure includes an engagement structure movable with the capping structure to selectively operatively engage the fairing structure to shift the fairing structure from a deployed position toward a nondeployed position.

4. A printing device according to claim 3, further comprising a cleaning structure operatively associated with the engagement structure and operable to clean the fairing structure.

5. A printing device according to claim 1, wherein the fairing structure is pivotally attached to the ink-dispensing structure.

6. A printing device according to claim 1, wherein the fairing structure is slidably attached to the ink-dispensing structure.

7. A printing device, comprising:

an ink-dispensing structure which carries a printhead with a leading edge, and which moves in a printing sweep downstream across a printzone;

a fairing structure; and a mounting structure which supports the fairing structure for movement with the printhead downstream from the leading edge of the printhead in a position configured to reduce aerodynamic turbulence associated with the leading edge of the printhead during movement of the printhead downstream across the printzone;

wherein the leading edge lies substantially in a plane which generally faces the printzone, and wherein the fairing structure defines a surface which, with the fairing structure in a deployed position, lies substantially in the plane, and which, with the fairing structure in a nondeployed position, lies spaced from the plane.

8. A printing device, comprising:

an ink-dispensing structure which carries a printhead with a leading edge, and which moves in a printing sweep downstream across a printzone;

a fairing structure;

a mounting structure which supports the fairing structure for movement with the printhead downstream from the leading edge of the printhead in a position configured to reduce aerodynamic turbulence associated with the leading edge of the printhead during movement of the printhead downstream across the printzone; and an actuator structure disposed along a travel path of the printhead, the actuator structure being configured to operatively engage the fairing structure on selected movement of the fairing structure to shift the fairing structure from a deployed position toward a nondeployed position.

9. A printing device according to claim 8, wherein the actuator structure includes a camming ramp structure mounted adjacent at least one end of travel.

10. A printing device according to claim 9, further comprising a cleaning structure operatively associated with the actuator structure and operable to clean the fairing structure.

11. A method of reducing aerodynamic swath-height error in a printer having an ink-dispensing structure with a leading edge, comprising:

moving the ink-dispensing structure in a printing sweep downstream across a printzone during a printing operation;

establishing an aerodynamic fairing structure downstream of the leading edge of the ink-dispensing structure, the fairing structure being capable of reducing aerodynamic turbulence which would otherwise result in a vicinity of the leading edge of the printhead as the ink-dispensing structure moves across the printzone; and selectively positioning the fairing structure in a position adjacent the leading edge of the ink-dispensing structure to reduce aerodynamic turbulence in the vicinity of the leading edge during said moving.

12. A method of reducing aerodynamic swath-height error in a printer having ink-dispensing printhead structure including a printhead which moves with an advancing leading edge in a printing sweep downstream across a printzone during a printing operation, the method comprising the steps of:

moving the printhead with the advancing leading edge downstream across the printzone; and while moving the printhead, employing a likewise-advancing aerodynamic barrier at a location adjacent, traveling with, and downstream from the advancing leading edge of the printhead, thereby reducing aerodynamic turbulence adjacent the advancing leading edge of the printhead relative to aerodynamic turbulence which would otherwise be produced adjacent the advancing leading edge of the printhead upon moving the printhead downstream across the printzone.

13. Apparatus for reducing aerodynamic swath-height error in a printing device having an ink-dispensing structure which moves with an advancing leading edge in a printing sweep downstream across a printzone during a printing operation, the apparatus comprising:

fairing means for impacting air flow in said printzone; and mounting means for mounting the aerodynamic fairing for movement with the printhead at a location downstream from the leading edge of the printhead, and in a position relative to the printhead which is effective, during movement of the printhead downstream, to displace aerodynamic turbulence which would otherwise result in a vicinity of the leading edge of the printhead during advancement of the printhead downstream.

14. The apparatus of claim 13, wherein the leading edge of the printhead lies substantially in a plane which generally faces the printzone, and wherein the aerodynamic fairing defines a surface which also lies generally within the plane during movement of the printhead and aerodynamic fairing across the printzone.

15. A method of printing, comprising:

deploying a fairing adjacent the downstream portion of the printhead;

scanning a printhead and deployed fairing structure downstream across a printzone;

ejecting ink droplets from the printhead onto media, during said scanning;

controlling airflow turbulence between the printhead and the media; and in response to said controlling, depositing the ejected droplets in a preselected pattern on the media to form a desired image.

16. The method of claim 15, wherein said controlling airflow turbulence includes sheltering a leading edge of the printhead with the deployed fairing structure during said scanning.

17. A method of printing, comprising:

scanning a printhead downstream across a printzone;

ejecting ink droplets from the printhead onto media, during said scanning;

controlling airflow turbulence between the printhead and the media, including disrupting static air downstream from a leading edge of the printhead during said scanning; and in response to said controlling, depositing the ejected droplets in a preselected pattern on the media to form a desired image.

* * * * *

UNITED STATES PATENT AND TRADEMARK OFFICE

CERTIFICATE OF CORRECTION

PATENT NO. : 7,044,582 B2
APPLICATION NO. : 10/401924
DATED : May 16, 2006
INVENTOR(S) : Daniel J. Fredrickson et al.

It is certified that error appears in the above-identified patent and that said Letters Patent is hereby corrected as shown below:

On the face page, in field (73), in "Assignee", in column 1, line 1, delete "Parkard" and insert -- Packard --, therefor.

In column 4, line 14, after "exit" delete "30,".

Signed and Sealed this

Sixteenth Day of June, 2009

JOHN DOLL
*Acting Director of the United States Patent and Trademark Office*